US005088200A

United States Patent [19]

Piwaron et al.

[11] Patent Number: 5,088,200

[45] Date of Patent: Feb. 18, 1992

[54] HAIR TRIMMER HAVING A LOW-FRICTION ROTARY DRIVE

[75] Inventors: John M. Piwaron, Milwaukee; Daniel L. Sukow, Grafton; Matthew L. Andis, Racine, all of Wis.

[73] Assignee: Andis Company, Racine, Wis.

[21] Appl. No.: 595,590

[22] Filed: Oct. 11, 1990

[51] Int. Cl.[5] ..... B26B 19/02

[52] U.S. Cl. ..... 30/216; 30/43.92

[58] Field of Search ..... 30/216, 220, 215, 43.92

[56] References Cited

U.S. PATENT DOCUMENTS

| | | | |
|---|---|---|---|
| 3,074,161 | 1/1963 | Liska | 30/43 |
| 3,178,818 | 4/1965 | Liska | 30/354 |
| 3,399,454 | 9/1968 | Liska | 30/43.92 |
| 3,423,826 | 1/1969 | Liska | 30/43.92 |
| 3,460,250 | 8/1969 | Liska | 30/221 |
| 3,815,232 | 6/1974 | Liska | 30/346.51 |
| 4,219,930 | 9/1980 | Franko et al. | 30/43.92 |
| 4,380,121 | 4/1983 | Namier et al. | 30/42 |
| 4,408,392 | 10/1983 | Naimer | 30/34.1 |
| 4,649,642 | 3/1987 | Nagasaki et al. | 30/43.92 X |
| 4,803,780 | 2/1989 | Locke et al. | 30/34.1 |
| 4,805,300 | 2/1989 | Miska | 30/34.1 |
| 4,896,420 | 1/1990 | Locke | 30/34.2 |

*Primary Examiner*—Douglas D. Watts

*Attorney, Agent, or Firm*—Michael, Best & Friedrich

[57] ABSTRACT

A hair trimmer including a body adapted to support a cutting assembly having a reciprocable cutter, a rotatable drive housed by the body for reciprocating the cutter, and a hinge including a guide plate and a reciprocable yoke support which is engaged with the drive and which is reciprocably movable with respect to the guide plate for guiding movement of the drive relative to the guide plate.

10 Claims, 2 Drawing Sheets

HAIR TRIMMER HAVING A LOW-FRICTION ROTARY DRIVE

BACKGROUND OF THE INVENTION

1. Technical Field

The invention relates generally to hair trimmers and to electric shavers having hair trimmers, and more particularly to hair trimmers and electric shavers having rotary drives.

2. Related Prior Art

The provision of a hair trimmer including a rotary drive for actuating an associated reciprocable cutting assembly is generally known in the hair trimmer art and in the related art of electric shavers.

Attention is directed to the following U.S. Pat. Nos. which illustrate various hair trimmers and electric shavers having rotary drives for actuating a reciprocable cutting assembly:

| | | |
|---|---|---|
| 3,074,161 | Liska | January 22, 1963 |
| 3,178,818 | Liska | April 20, 1965 |
| 3,399,454 | Liska | September 3, 1968 |
| 3,423,826 | Liska | January 28, 1969 |
| 4,219,930 | Franko et al. | September 2, 1980 |
| 4,408,392 | Naimer | October 11, 1983 |
| 4,803,780 | Locke et al. | February 14, 1989 |
| 4,805,300 | Miska | February 21, 1989 |
| 4,896,420 | Locke | January 30, 1990 |

SUMMARY OF THE INVENTION

The invention provides an electric hair trimmer including an electrically-powered rotary drive adapted to impart a reciprocating motion to a cutting assembly, and a hinge for supporting a portion of the rotary drive and for guiding the portion of the rotary drive. More particularly, the trimmer includes a cutting head assembly having a reciprocable cutter, a drive shaft which is driven by an electric motor and which supports a cam for eccentric rotation of the cam, and a drive member which engages the eccentrically rotatable cam, extends from the trimmer, and which is adapted to operably engage the reciprocable cutter.

The hinge supports the drive member in engagement with the cam and guides the drive member so that eccentric rotation of the cam results in reciprocating linear movement of the drive member. In one embodiment, the hinge includes a drive member support, a base fixed to the trimmer, and a pair of living hinges extending between the base and the drive member support. The living hinges hold the drive member support and flex in response to eccentric rotation of the cam. Preferably, the living hinges are thin-walled plastic members which have the capacity to absorb the energy of repeated flexing without failure due to fatigue.

In one embodiment, the hinge also includes a pair of guide blocks which extend from the base and which are engageable with the drive member support to guide the drive member support as the drive member support reciprocates. Under normal operating conditions, the guide blocks are in closely spaced relation to the drive member support. Under some operating conditions, however, the drive member can be deflected by rearward loading on the cutting assembly. Under such conditions, the guide blocks slidingly contact the drive member support by means of a low-friction surface to control and contain the movement of the drive member.

In one embodiment, the hinge, including the base, the living hinges, the guide blocks and the drive member support, is integrally formed of plastic, such as polypropylene. The invention thus provides a hinge for supporting a rotary drive of an electric trimmer and for guiding the rotary drive.

Various other features and advantages of the invention will become apparent to those skilled in the art upon review of the following detailed description, claims and drawings.

Figure 7:
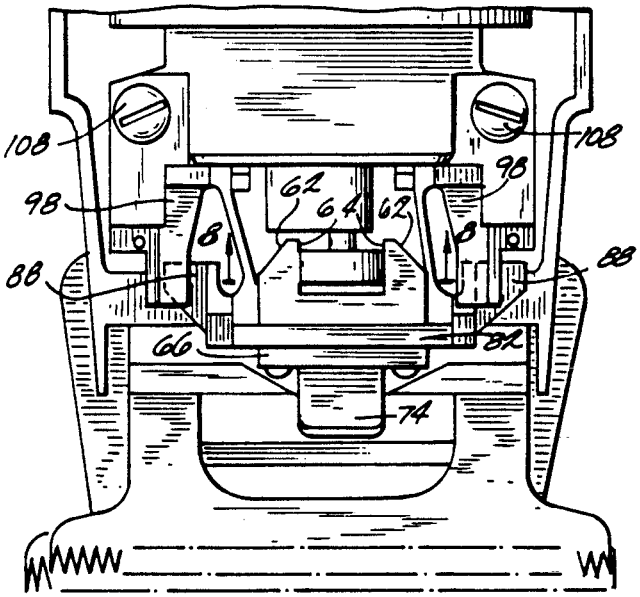
FIG. 7 is a view similar to FIG. 4 showing the electric hair trimmer in a different position.

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Illustrated in the drawings is an electric hair trimmer 10 having a body 12 which is formed to be easily handheld. Preferably, the body 12 is made of a light-weight, rigid plastic and is generally hollow.

Figure 4:
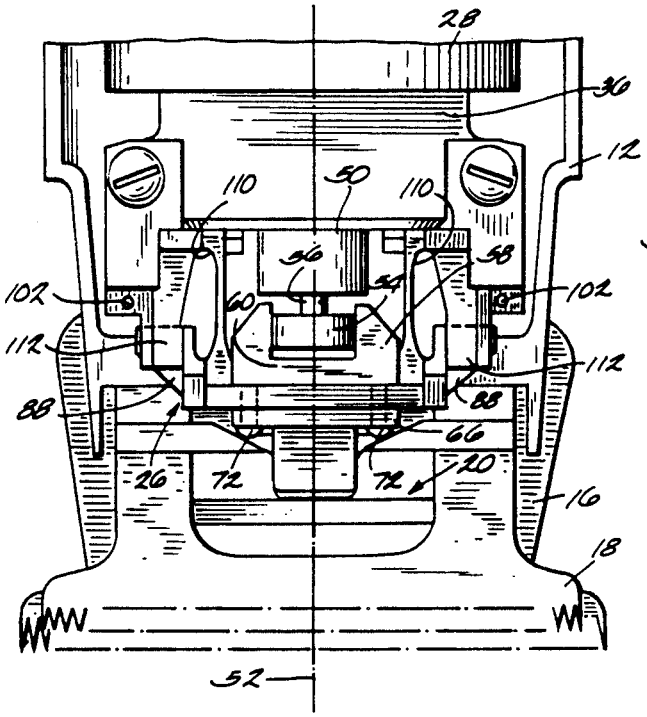
FIG. 4 is a plan view from above, partially broken away for illustration, of a portion of the electric hair trimmer illustrated in FIG. 1.
Figure 2:
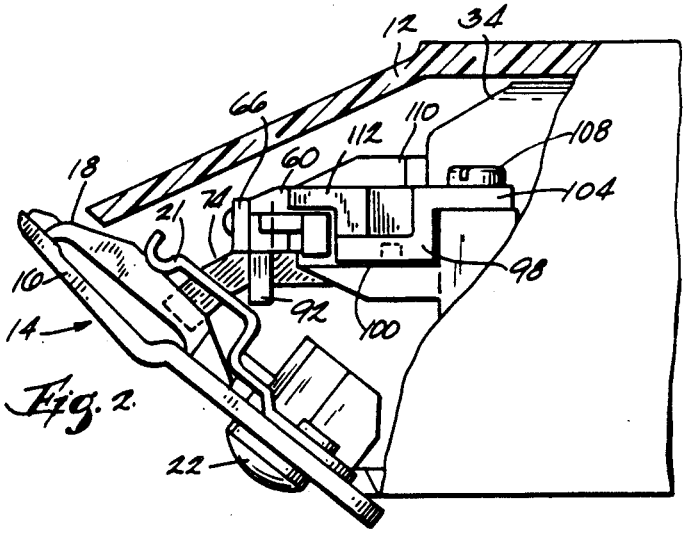
FIG. 2 is an enlarged view, partially broken away for illustration, of a portion of the electric hair trimmer illustrated in FIG. 1.

A cutting head assembly or blade set 14 is supported at one end of the trimmer body 12 by a fastener 15. Preferably, the cutting head assembly 14 includes a lower plate 16 and an upper plate 18 which is supported on the lower plate 16 and which is reciprocably movable with respect to the lower plate 16. The upper plate 18 defines (FIG. 4) a drive socket 20 which, as fully explained below, receives a reciprocating drive mechanism. As shown in FIG. 2, a leaf spring 21 which is fixed to the bottom plate 16 by a fastener 22 biases the upper plate 18 against the lower plate 16 in order to provide sufficient pressure therebetween for effective cutting.

Figure 1:
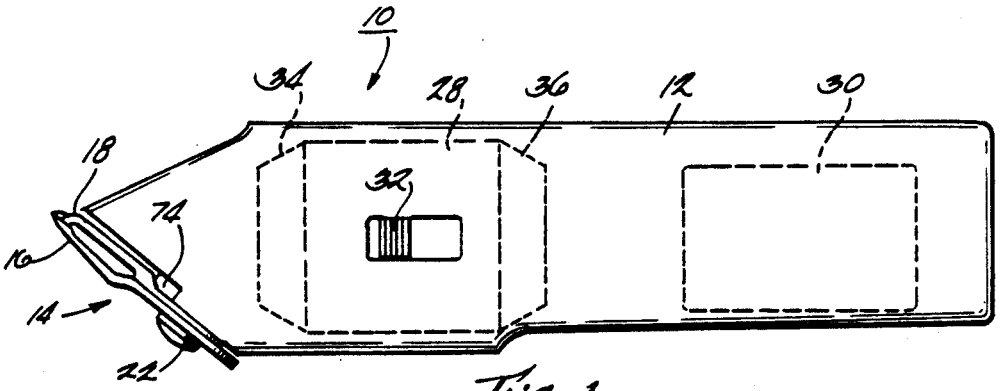
FIG. 1 is a side elevational view of an electric hair trimmer embodying various features of the invention.

The electric trimmer 10 also includes rotary drive means 26 housed by the body 12 for reciprocatingly driving the cutting head assembly 14. While various constructions could be successfully employed, in the illustrated embodiment, the drive means 26 includes an electric motor 28 which is housed by the trimmer body 12 and which is operably connected to a suitable source of electric current 30. In FIG. 1, the source of current 30 is schematically represented by a battery housed by the trimmer body. However, the electric motor 28 could also be connected to a suitable source of power by means of an electric cord extending from the body. A user operable thumb switch 32 for turning the electric motor 28 "on" and "off" extends from the clipper body.

Figure 5:
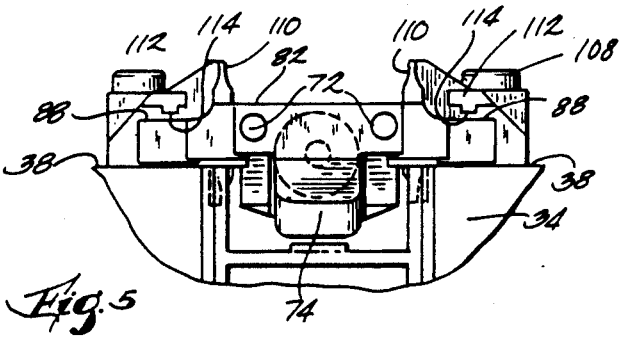
FIG. 5 is a front elevational view of the electric hair trimmer illustrated in FIG. 4.
Figure 6:
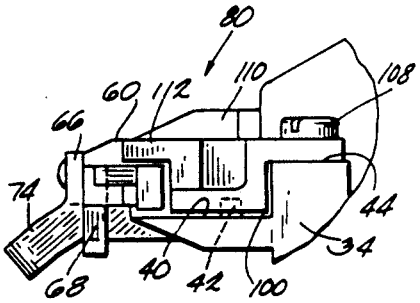
FIG. 6 is a side elevational view of the electric hair trimmer shown in FIG. 5.

The drive means 26 also includes a front motor frame 34 and a rear motor frame 36 which are fixed respectively to the front and rear ends of the electric motor 28. The front motor frame 34 is fixed to the body 12, secures the electric motor 28 in position within the body, and defines (FIG. 5) a pair of hinge mounting surfaces 38. For reasons explained fully below, each hinge mounting surface 38 includes (FIG. 6) a first portion 40 which is generally planar and which has extending upwardly therefrom a location pin 42, and a second portion 44 which is generally planar and which has a hole therein (not shown).

The drive means 26 for driving the cutting head assembly 14 also includes a rotatable drive shaft 50 which extends from the front end of the electric motor 28 through the front motor frame 34 and which is driven by the electric motor 28 about axis 52. The end of the drive shaft 50 extending from the front motor frame 34 supports a cam 54 for eccentric rotation of the cam 54 when the drive shaft 50 is rotated. In the illustrated embodiment, the cam 54 is generally cylindrical and is fixed to the drive shaft 50 by a connecting pin 56 which is offset from the axis 52 of the drive shaft 50. When the drive shaft 50 rotates, the cam 54 rotates eccentrically about the axis 52 of the drive shaft 50 due to the offset location of the connecting pin 56 with respect to the axis of rotation 52.

The drive means 26 for driving the cutting head assembly 14 also includes a yoke 58 engaged with the cam 54 for converting the eccentric rotary motion of the cam 54 to a reciprocating linear motion. The yoke 58 includes a rear plate 60 and a pair of cam followers 62 disposed on the rear plate 60 and extending rearwardly therefrom. The followers 62 are spaced-apart and have (FIG. 7) generally vertically extending follower surfaces 64 which are in mutually opposed facing relation. The follower surfaces 64 are sufficiently spaced-apart to slidingly engage the circumference of the cam 54. The yoke 58 also includes a front plate 66 which is integrally formed with the rear plate 60 by means of a bight portion 68 which extends between the lower edges of the rear and front plates 60, 66. The front plate 66, bight portion 68 and rear plate 60 thus form an upwardly opening U-shaped member which defines a space therebetween. A pair of holes (not shown) extend through the front and rear plates 66, 60 and are adapted to house a pair of fasteners 72 for reasons explained below. The yoke 58 also includes a drive lever 74 which extends forwardly from the bight portion 68 below the front plate 66 and which is adapted to engage the socket 20 of the cutting head assembly 14 so as to impart reciprocating linear movement to the upper plate 18 of the cutting head assembly 14.

Figure 3:
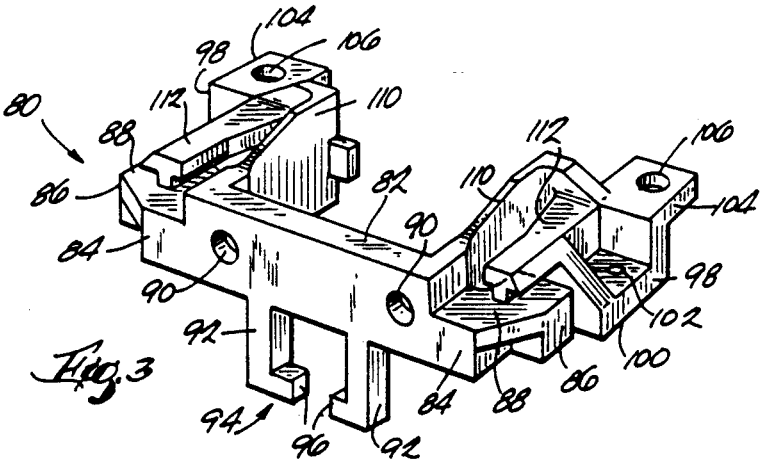
FIG. 3 is a perspective view of a portion of the electric hair trimmer illustrated in FIG. 2.

The hair trimmer 10 also includes hinge means 80 which is supported on the trimmer body 12 and which supports the yoke 58 for lateral reciprocable movement relative to the body 12 and which supports the yoke 58 for low-friction rearward support. While various other constructions could be employed, in the preferred embodiment, the hinge means 80 includes (FIG. 3) a yoke support or cross-bar 82 which has opposite ends 84 and which is located in the space between the front plate 66 and rear plate 60 of the yoke 58. A pair of wings 86 extend outwardly in opposite directions from the ends 84 of the cross bar 82, and each wing 86 has a generally planar upper surface 88. A pair of holes 90 extend through the cross bar 82 and, when the hinge means 80 is mounted on the body 12, the pair of holes 90 in the cross-bar register with the holes 70 extending through the front 66 and rear plates 60 of the yoke 58. The pair of fasteners 72 which are housed by the holes 70 fix the yoke 58 to the cross bar 82. A pair of legs 92 extend downwardly from the cross bar 82 to form a drive lever clip 94 which engages the bight portion 68 of the yoke 58. Preferably, each leg 92 includes an inwardly turned end 96 so that the cross bar 82 can be snapped into position on the yoke 58 and so that the drive lever 74 extends through the drive lever clip 94.

The hinge means 80 also includes a pair of base plates 98 which are fixed in a position overlying hinge mounting surfaces 38 on the front motor frame 34. Preferably, each base plate 98 has a generally planar bottom surface 100 and a hole 102 extending therethrough which is adapted to receive a respective location pin 42 so as to properly position the hinge means 80 on the front motor frame 34 for ease of assembly. Each base plate 98 also includes a flange 104 having a hole 106 therethrough which, when the base plates 98 are positioned on the hinge mounting surface 38, registers with the hole 46 in the second portion 44 of the hinge mounting surface 38, and which is adapted to house a suitable fastener 108 in order to secure the base plate 98 to the front motor frame 34. In the illustrated embodiment a screw extends through the hole 106 in the flange 104 and into the front motor frame 34 to secure the base plate 98 to the front motor frame 34.

Figure 8:
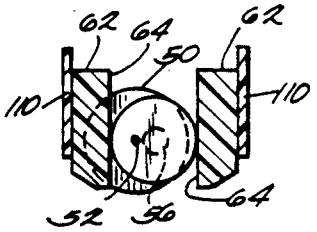
FIG. 8 is a cross-sectional view, taken along 8—8 in FIG. 7.

The hinge means 80 also includes a pair of hinge arms 110 respectively extending between the base plates 98 and the cross bar 82. In the preferred embodiment, the hinge arms 110 are thin-walled plastic members or living hinges. Preferably, (FIG. 8) the hinge arms 110 are joined to the cross bar 82 at points adjacent the edges of the rear plate 60 and hold the cross bar 82 so that the follower surfaces 64 on the yoke 58 slidingly engage the cam 54. In response to eccentric rotation of the cam 54, the hinge arms 110 flex laterally (i.e. in a direction normal to the follower surfaces 64) to afford reciprocal linear displacement of the yoke 58 and the cross bar 82. The hinge arms 110 are respectively integrally formed with the base plates 98 and the cross bar 82 and have a relatively high capacity to absorb the energy of repeated reciprocal flexing without failing due to fatigue.

During normal operation of the electric trimmer 10, the electric motor 28 rotates the drive shaft 50 and causes eccentric rotation of the cam 54. The yoke 58 engages the eccentrically rotating cam 54 by means of the follower surfaces 64 and is supported by the hinge arms 110 to convert the eccentric rotation of the cam 54 into a reciprocable linear motion. The follower surfaces 64 slidingly engage the eccentrically rotating cam 54 and move laterally from side to side as the cam 54 rotates eccentrically. The follower surfaces 64 of the yoke 58 convert the eccentric rotation of the cam 54 into a linear reciprocating motion. The lateral component of the eccentric motion of the cam 54 causes the hinge arms 110 to deflect from a neutral position illustrated in FIG. 4, when the cam 54 is vertically aligned with the axis of rotation 52 of the shaft 50, to a displaced position, shown in FIGS. 7 and 8, when the cam 54 rotates away from vertical alignment with the axis of rotation 52 to horizontal alignment with the axis of rotation 52.

The hinge means 80 also provides low-friction rearward support for the yoke 58. Preferably, rearward support of the yoke 58 is provided by a pair of guide plates or blocks 112 which extend from a respective base plate 98 in a direction generally parallel to the hinge arms 110 toward the ends 84 of the cross bar 82. Each guide block 112 includes (FIG. 5) a generally planar guide surface 114 which is in closely-spaced opposed facing relation to a respective upper wing surface 88. The guide surfaces 114 and the upper wing surfaces 88 are, under normal operation conditions, spaced-apart. However, under unusual operating conditions wherein the cutting head assembly 14 is under relatively heavy rearward loading, the drive lever 74 and yoke 58 can be deflected rearwardly. Under such operating conditions, the upper wing surfaces 88 can move into low-friction, sliding engagement with the guide surfaces 114. The guide surfaces 114 thus serve to control and contain the movement of the yoke 58 and drive lever 74 under rearwardly directed loading by guiding the lateral reciprocal movement of the cross member 82 and by preventing excessive rearward deflection thereof. The trimmer 10 thus provides a hinge 80 including a guide plate 112, a reciprocable yoke support 82 which is engaged with a rotary drive 26, and which is reciprocably moveable with respect to the guide plate 112, and means for guiding movement of the yoke support relative to the guide plate.

Preferably, the hinge 80, including the base plates 98, the yoke support 82, the hinge arms 110, and the guide members 112, is integrally formed of a suitable plastic into a single unit. Polypropylene, for example, can be used as a material for the hinge.

Various features of the invention are set forth in the following claims.

We claim:

1. A hair trimmer comprising a body adapted to support a cutting assembly having a reciprocable cutter, drive means housed by said body for reciprocating the cutter, a hinge including a guide plate, and a reciprocable yoke supported engaged with said drive means and being reciprocably moveable with respect to said guide plate, and having thereon means movably engaging said guide plate for guiding movement of said yoke support relative to said guide plate.

2. A hair trimmer comprising a body adapted to support a cutting assembly having a reciprocable cutter, drive means housed by said body for reciprocating the cutter, a hinge including a guide plate, and a reciprocable yoke support engaged with said drive means, being reciprocably moveable with respect to said guide plate, and slidingly engaging said guide plate for guiding low-friction relative movement therebetween.

3. A hair trimmer as set forth in claim 2 wherein said hinge includes a base plate fixed too said body, and including a thin-wall segment extending between said base plate and said yoke support.

4. A hair trimmer as set forth inn clam 3 wherein said guide plate extends from said base plate and includes a guide surface which is slidingly engageable with said yoke support.

5. A hair trimmer as set forth in claim 1 wherein said hinge is integrally formed of plastic.

6. A hair trimmer comprising a body adapted to support a cutting head assembly having a reciprocable cutter, drive means for reciprocating the cutter, said drive means including a yoke and a drive lever supported by said yoke and adapted to drivingly engage the cutting head assembly, and a hinge mounted on said body and supporting said yoke for reciprocal movement, said hinge including a yoke support fixed to said yoke and having opposite ends, a pair of wings respectively extending in opposite directions from said opposite ends, a pair of hinge arms respectively extending from said opposite ends and being generally mutually parallel, a pair of base plates respectively fixed to said hinge arms and being mounted to said body, and a pair of guide blocks respectively extending from said base plates and being respectively slidingly engageable with said wings.

7. An electric hair trimmer as set forth in claim 6 wherein said hinge arms are thin, plastic walls integrally formed with the yoke support and the base plates.

8. An electric hair trimmer as set forth in claim 7 wherein said guide blocks slidingly engage said wings for low-friction support of said hinge.

9. A hair trimmer for use with a cutting head assembly having a reciprocable cutter, said trimmer comprising a body, means housed by said body for driving the cutting assembly, said means including a motor, a rotatable shaft driven by said motor, a cam supported by said shaft for eccentric rotation, a yoke engaged with said cam, and a drive lever extending from said yoke and being adapted to operably engage the reciprocable cutter, and hinge means supported on said body and supporting said yoke for lateral reciprocable movement relative to said body and supporting said yoke for low-friction rearward support.

10. A hair trimmer as set forth in claim 9 wherein said hinge extends between said base plate and said yoke.

* * * * *